US006484351B2

(12) United States Patent
Griffin et al.

(10) Patent No.: US 6,484,351 B2
(45) Date of Patent: Nov. 26, 2002

(54) LATCHING SYSTEM FOR A VACUUM CLEANER WITH DETACHABLE BLOWER

(75) Inventors: Ronald Griffin, Williamsport, PA (US); Craig A. Seasholtz, Avis, PA (US)

(73) Assignee: Shop Vac Corporation, Williamsport, PA (US)

( * ) Notice: Subject to any disclaimer, the term of this patent is extended or adjusted under 35 U.S.C. 154(b) by 32 days.

(21) Appl. No.: 09/821,960

(22) Filed: Mar. 30, 2001

(65) Prior Publication Data

US 2002/0138938 A1 Oct. 3, 2002

(51) Int. Cl.[7] ..... A47L 9/22
(52) U.S. Cl. ..... 15/329; 15/339
(58) Field of Search ..... 15/328, 329

(56) References Cited

U.S. PATENT DOCUMENTS 2,456,639 A * 12/1948 Lanter ..... 15/327.1
4,880,364 A 11/1989 Berfield et al.
5,294,063 A * 3/1994 Bote ..... 15/329
5,404,614 A 4/1995 Stephens
5,611,107 A * 3/1997 Tomasiak et al. ..... 15/327.2
6,055,700 A 5/2000 Holsten et al.

* cited by examiner

*Primary Examiner*—Chris K. Moore
(74) *Attorney, Agent, or Firm*—Marshall, Gerstein & Borun

(57) ABSTRACT

A vacuum cleaner is provided which includes a housing and a latch assembly disposed on the housing. The latch assembly includes a latch that is movable relative to the housing between a first state and a second state. The vacuum cleaner also includes a blower that is disposable on the housing and has a first state wherein the blower is detached from the housing and a second state wherein the blower is disposed on the housing. The blower includes a latching surface disposed adjacent the latch with the blower in the second state. The blower moves the latch between the first state and the second state as the blower is moved between the first state and the second state, and the latch engages the latching surface with the blower in the second state and the latch in the first state to secure the blower to the housing.

22 Claims, 10 Drawing Sheets

FIG. 10
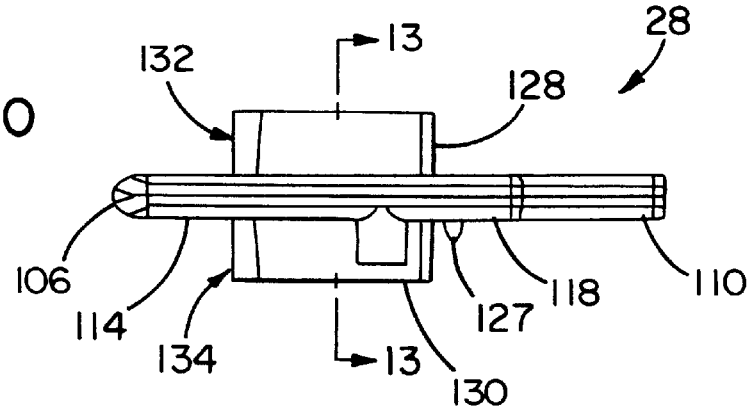
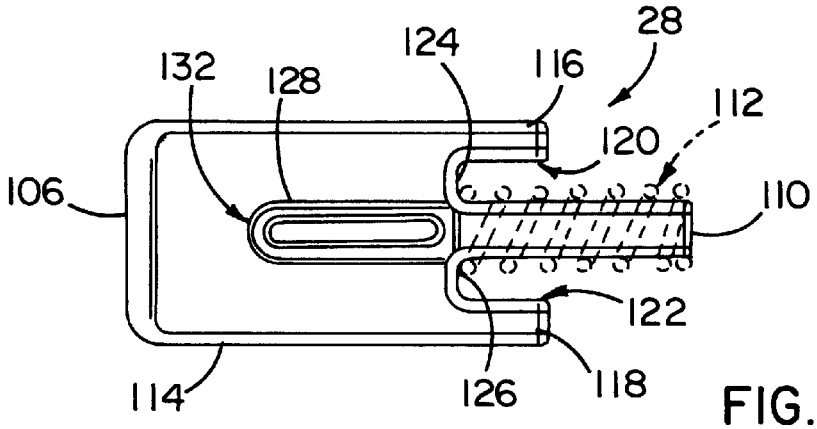
FIG. 11
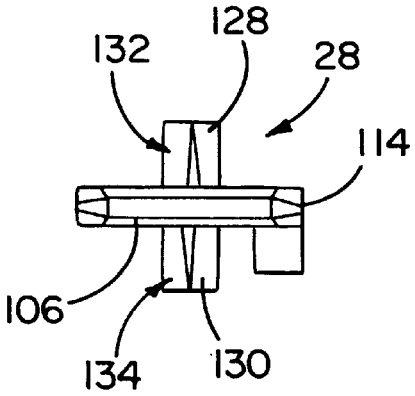
FIG. 12
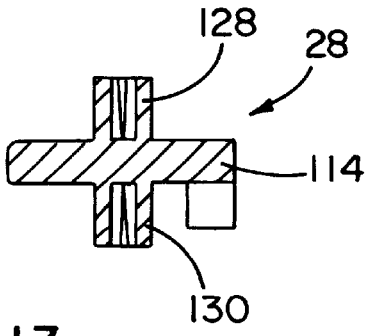
FIG. 13

LATCHING SYSTEM FOR A VACUUM CLEANER WITH DETACHABLE BLOWER

FIELD OF THE INVENTION

The present invention is directed to a vacuum cleaner with a detachable blower, and, in particular, to a latching system for a vacuum cleaner with a detachable blower.

BACKGROUND

Vacuum cleaners with detachable motorhead/power units, commonly referred to as blowers, are known in the art. When attached to a vacuum cleaner housing, the blower functions as part of the vacuum cleaner assembly. When detached from the vacuum cleaner housing, the blower may be used separately to provide a directable air column for the removal of leaves of other debris from a surface, for example.

In tank-type vacuum cleaners, the vacuum cleaner housing typically includes a lid or lid assembly which is fitted over a tank. The detachable blower is typically disposed on the lid or lid assembly. While the normal operation of the blower would typically tend to secure the detachable blower against the lid or lid assembly, the weight of the blower could cause the blower to become detached from the lid when the blower is non-operational. For example, if the blower is merely disposed on the lid or lid assembly and the user needs to remove the lid to empty the tank, it is possible that the user may tip the lid such that the blower detaches from the lid and falls to the ground. This can cause damage to the blower and injury to the user or others nearby.

One solution is to secure the blower to the lid using a latching system including one or more latches which have surfaces which cooperate with surfaces of the blower to attach the blower to the lid.

U.S. Pat. No. 4,880,364 shows one such latching system. The tank-type vacuum cleaner illustrated includes a vacuum cleaner housing, a blower disposed on the vacuum cleaner housing, and a latching system which permits one-handed detachment of the blower from the housing. In particular, the user depresses the latch illustrated in FIG. 12 and rotates the blower relative to the housing to disengage the bayonet-type locking arrangement. Once the bayonet-type locking arrangement has been disengaged, the user may remove or detach the blower from the housing.

An alternative latching system is showing U.S. Pat. No. 5,404,614. It is thought that the latching system used with the tank-type vacuum cleaner illustrated therein requires an angular movement of a handle to disengage a locking ring from a flange attached to the blower. Once the handle has been moved so as to disengage the locking ring from the flange, the blower may be removed or detached from the housing.

A further alternative latching system is shown in U.S. Pat. No. 6,055,700. The illustrated tank-type vacuum cleaner is thought to require a pivotal movement of a latch to disengage latching surfaces of the latch and the blower, thereby permitting the blower to be detached from the lid or lid assembly.

All of the above-mentioned latching systems have a similar disadvantage in that the user is required to actively disengage the latch when it is desired to detach the blower from the housing. While the blower may be detached one-handedly, as shown in U.S. Pat. No. 4,880,364, several movements must be performed to achieve the disengagement. The same can be said of the latches shown in U.S. Pat. Nos. 5,404,614 and 6,055,700.

SUMMARY

A vacuum cleaner is provided that includes a housing and a latch assembly disposed on the housing. The latch assembly includes a latch, which is movable relative to the housing between a first state and a second state. The vacuum cleaner also includes a blower, which is disposable on the housing and has a first state wherein the blower is detached from the housing and a second state wherein the blower is disposed on the housing. The blower includes a latching surface disposed adjacent the latch with the blower in the second state. The blower moves the latch between the first state and the second state as the blower is moved between the first state and the second state, and the latch engages the latching surface with the blower in the second state and the latch in the second state to secure the blower to the housing.

Also provided is a vacuum cleaner with a housing and a latch assembly disposed on the housing, the latch assembly including a latch linearly moveable relative to the housing between an extended state and a retracted state and having a forward edge. The vacuum cleaner also includes a blower disposable on the housing and having a first, detached state wherein the blower is detached from the housing and a second, combined state wherein the blower is disposed on the housing. The blower includes a wall having a first, outer surface which abuts the forward edge with the blower in a third state intermediate between the detached and combined states and a second, latching surface disposed adjacent the latch with the blower in the second state. The outer surface of the blower abuts the forward edge of the latch to move the latch between the extended and retracted states as the blower is moved between the detached and combined states and the forward edge of the latch engages the latching surface with the blower in the combined state and the latch in the extended state to secure the blower to the housing.

Further provided is a vacuum cleaner including a housing, a detachable blower with a handle, and a latching assembly including a latch that engages the blower with the blower disposed on the housing to secure the blower to the housing. The handle of the blower is graspable with both hands to apply an upward force to the blower to disengage the latch from the blower and thereby detach the blower from the housing. Moreover, the housing may include a surface on which the thumbs of both hands are disposed as the upward force is applied to the blower to disengage the latch from the blower.

BRIEF DESCRIPTION OF THE DRAWINGS

FIG. 10 is a side view of the latch shown in FIGS. 1–9;

FIG. 11 is a plan view of the latch of FIG. 10;

FIG. 12 is a frontal view of the latch of FIG. 10;

FIG. 13 is a cross-sectional view of the latch taken about line 13—13 in FIG. 10;

DETAILED DESCRIPTION OF THE EMBODIMENTS

Figure 1:
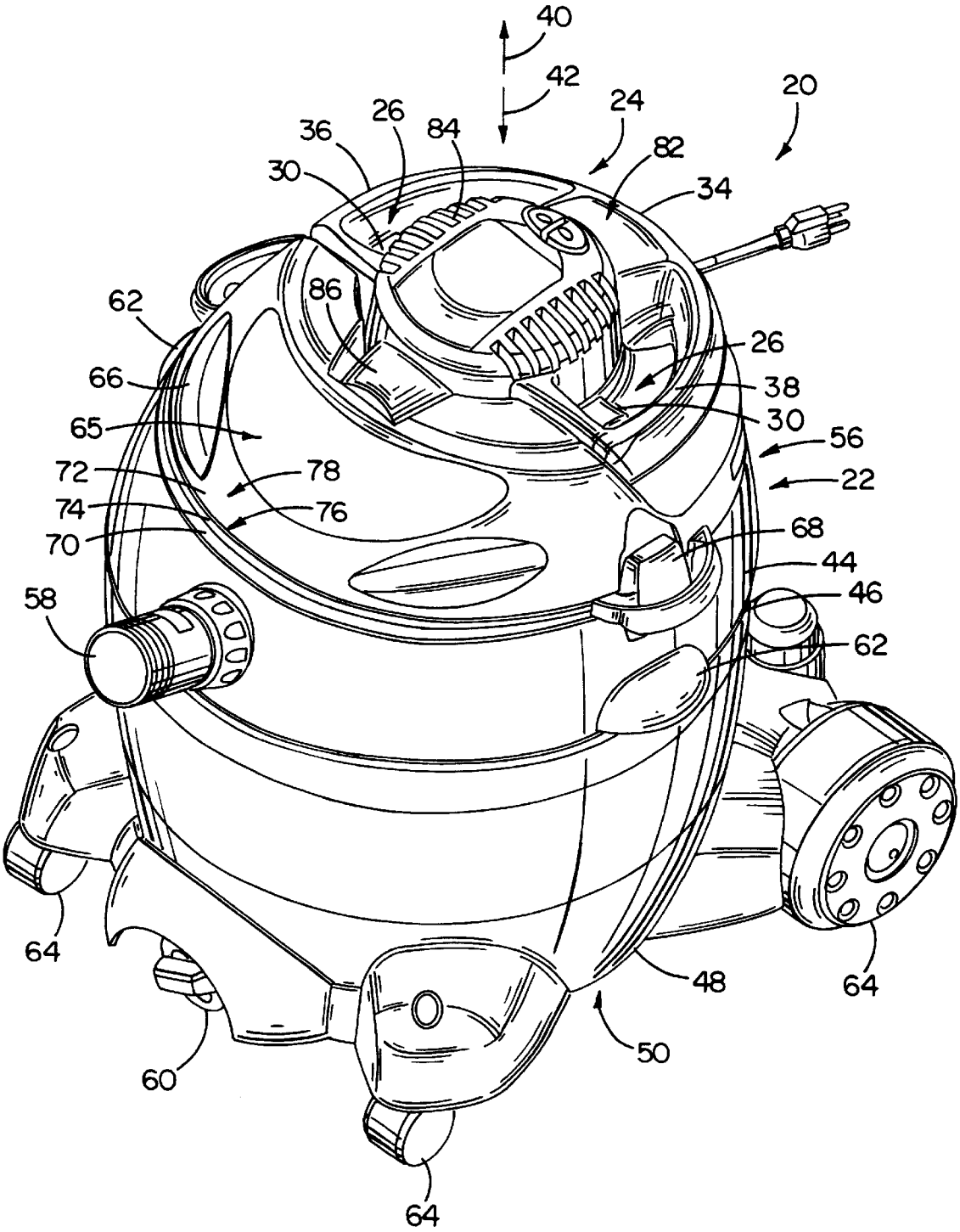
FIG. 1 is an isometric view of a vacuum cleaner with a detachable blower secured to a housing using latch assemblies including a first embodiment of a latch.
Figure 2:
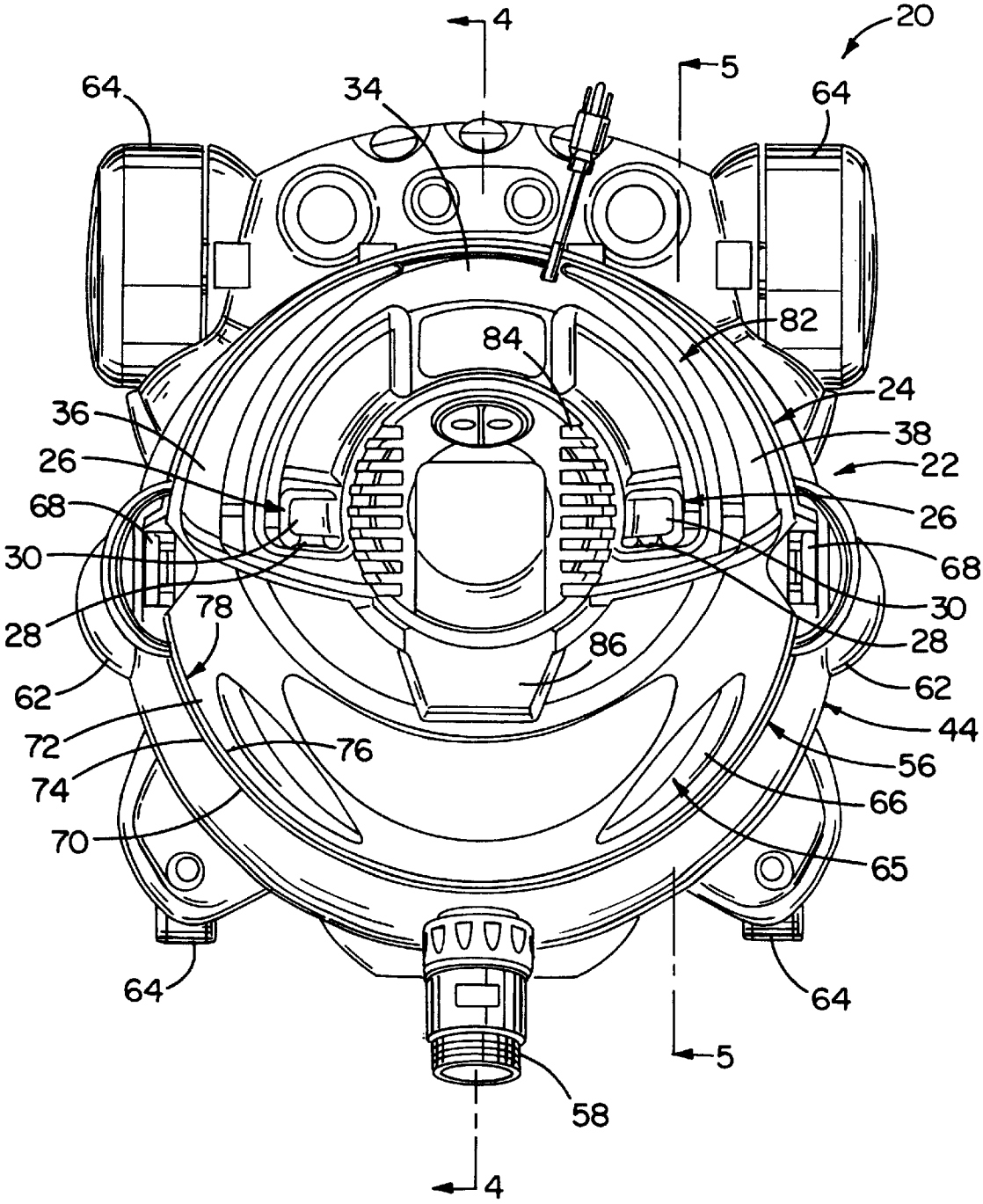
FIG. 2 is a plan view of the vacuum cleaner.
Figure 3:
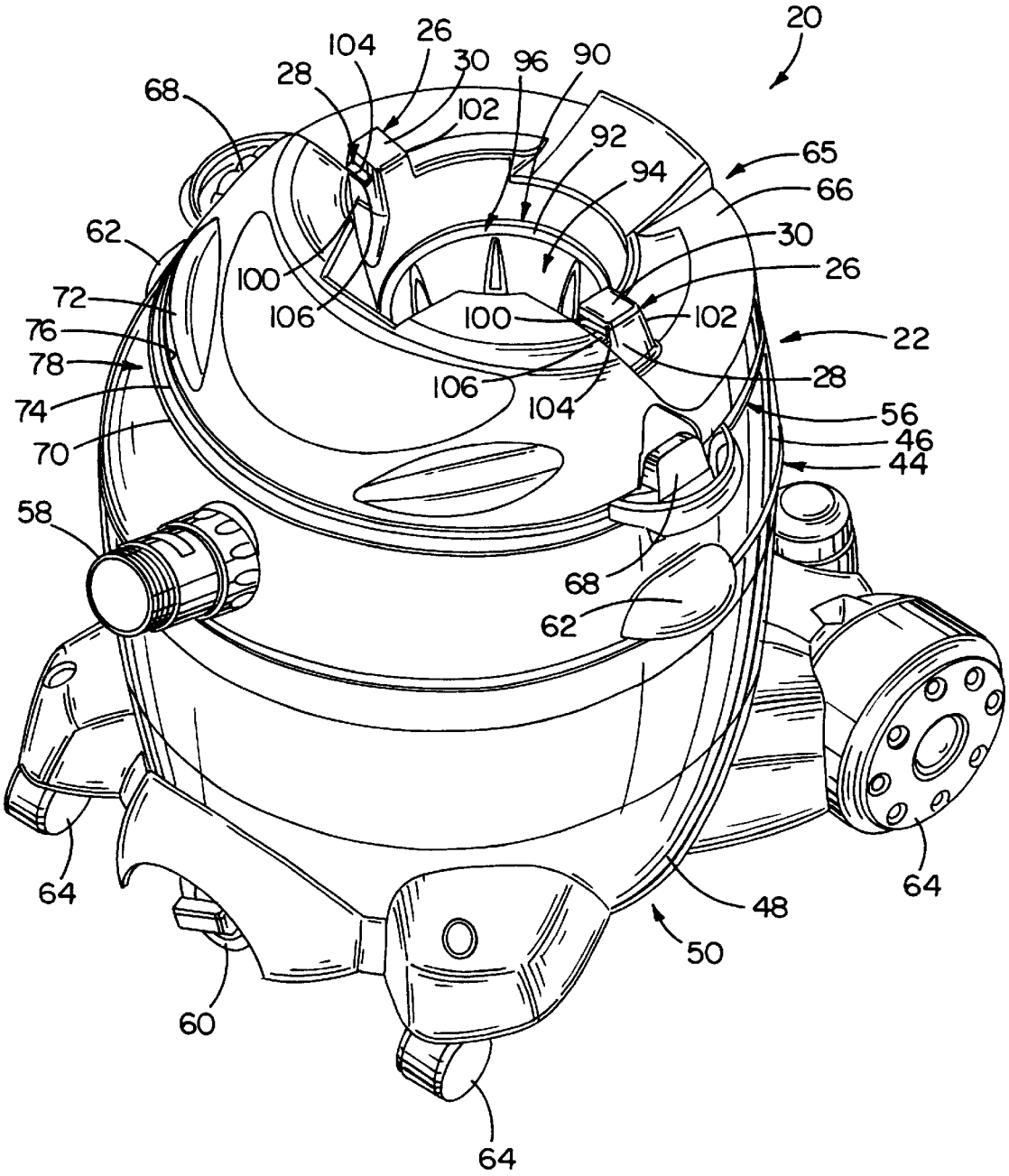
FIG. 3 is an isometric view of the vacuum cleaner with the blower removed.
Figure 4:
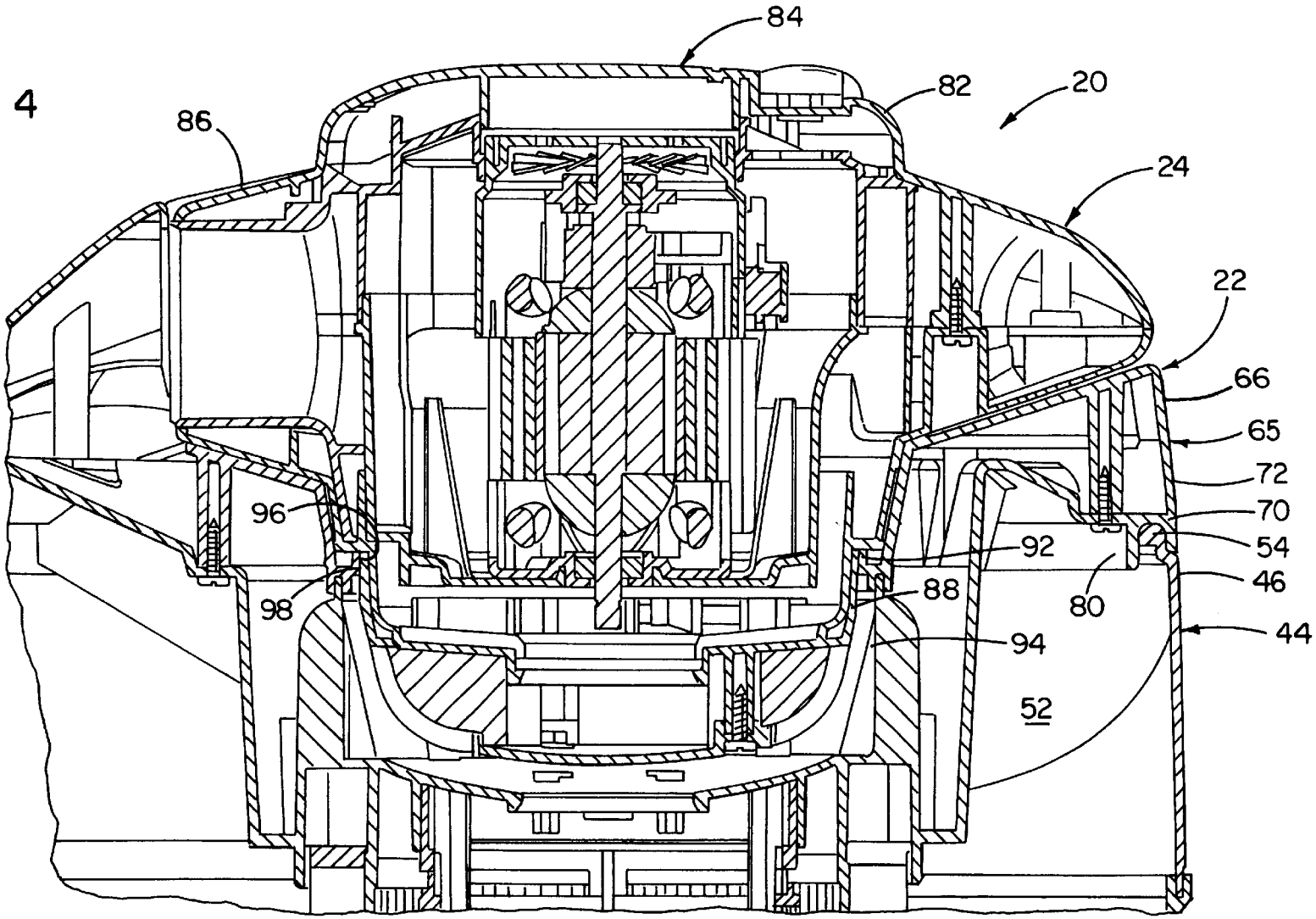
FIG. 4 is a partial, cross-sectional view of the vacuum cleaner taken about line 4-4 in FIG. 2.
Figure 5A:
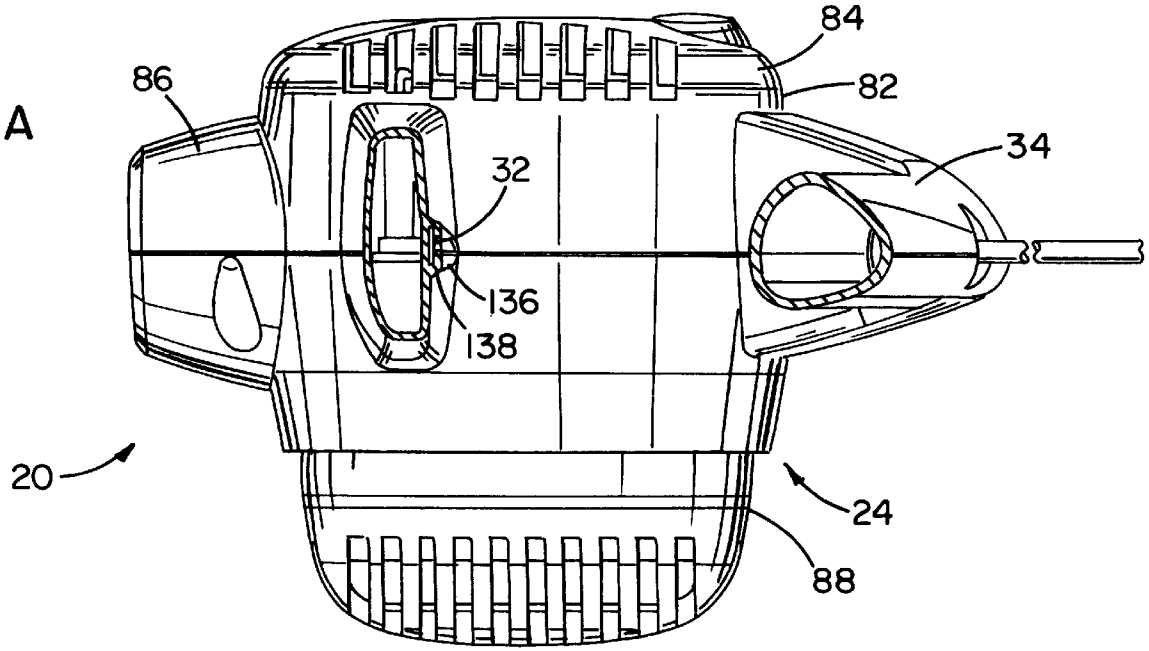
FIG. 5 is an enlarged, partial cross-sectional view of the vacuum cleaner taken about line 5—5 in FIG. 2 with the blower detached from the housing.
Figure 5B:
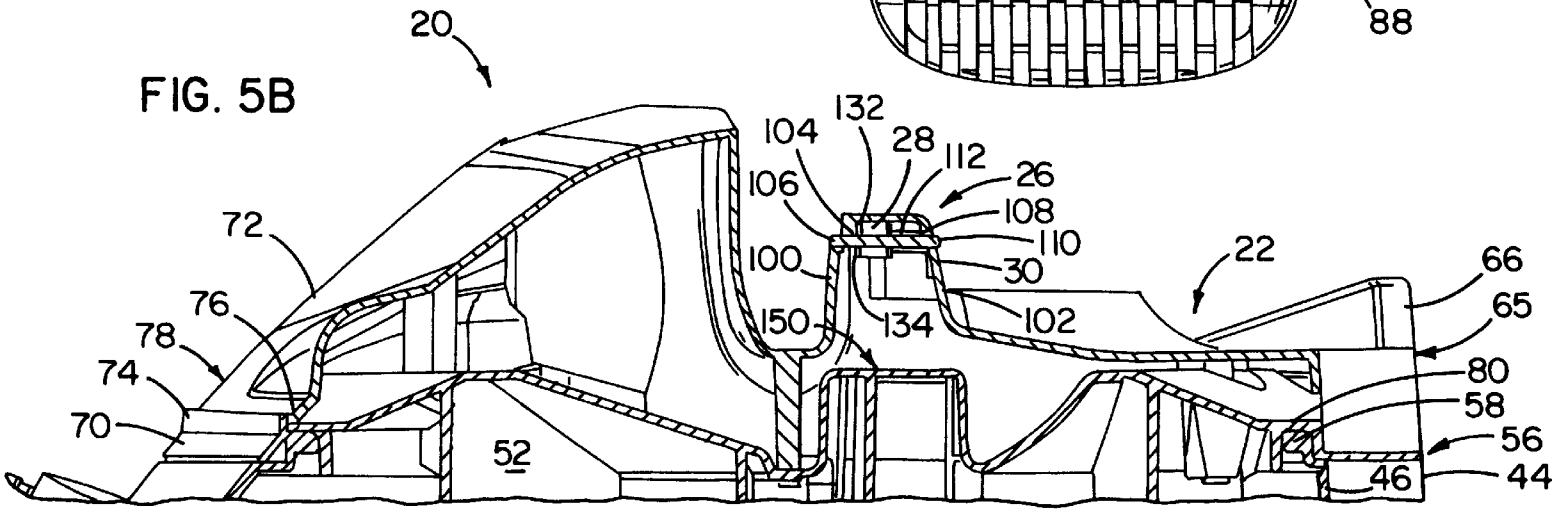
Figure 6:
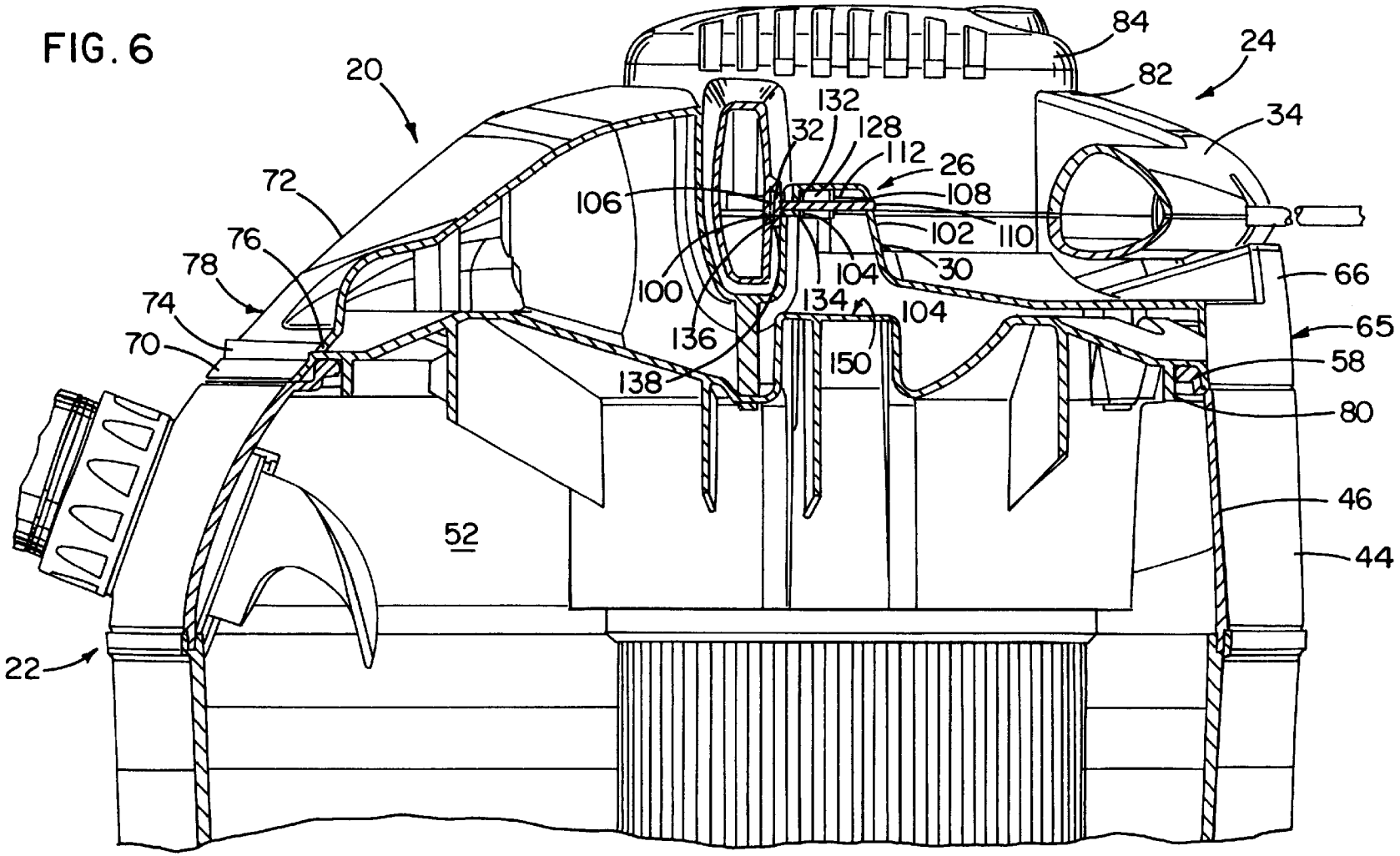
FIG. 6 is an enlarged, partial cross-sectional view of the vacuum cleaner taken about line 5—5 in FIG. 2 with the blower secured to the housing.

A vacuum cleaner 20 including a housing 22 and a detachable blower 24 is shown in FIGS. 1–9. The blower 24 has a first, detached state wherein the blower 24 is separated from the housing 22 (FIG. 5), and a second, combined state wherein the blower 24 is disposed on the housing 22 (FIG. 6). The vacuum cleaner 20 also includes one or more latch assemblies 26 attached to the housing 22 to secure the detachable blower 24 to the housing 22. Each latch assembly 26 includes a latch 28 disposed in a latch housing 30. The latch 28 moves relative to the housing 22 between a first, extended state (FIG. 7) and a second, retracted state (FIG. 9), preferably in a linear fashion.

Figure 7:
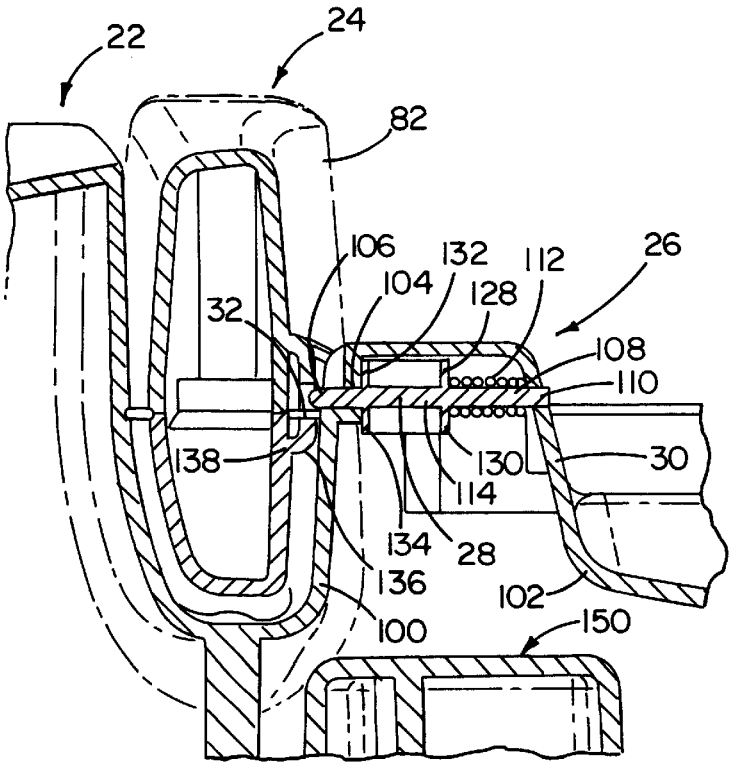
FIG. 7 is a further enlarged, partial cross-sectional view of the vacuum cleaner with the blower secured to the housing showing the cooperation of the blower and the latch.

As the blower 24 is moved between the first, detached state and the second, combined state, the blower 24 moves the latch 28 between the first, extended state and the second, retracted state. That is, as the blower 24 is moved from the first state to the second state (FIGS. 5 and 6), surfaces of the blower 24 and the latch 28 cooperate to move the latch 28 from the first state to the second state (FIGS. 8 and 9), and to permit the latch 28 to return to the first state with the blower 24 in the second state (FIGS. 6 and 7). With the blower 24 in the second state and the latch 28 in the first state, the latch 28 engages a latching surface 32 of the blower 24 to secure the blower 24 to the housing 22 (FIG. 7). Similarly, as the blower 24 is moved from the second state to the first state, the latch 28 will be moved from the first state to the second state, and then will be permitted to return to the first state with the blower 24 in the first state.

To facilitate the movement of the blower 24 between the first and secondstates, the blower 24 is equipped with a wrap-around handle 34. To move the blower 24 from, for example, the second state to the first state, the user grasps the handle 34 with both hands at the locations marked 36, 38 in FIG. 1 and applies an upwardly directed force to move the blower 24 in a first direction, as represented by an arrow 40. If additional leverage is required, the user may place his or her thumbs on a surface of the housing 22, and in particular on upwardly-facing surfaces of the latch housings 30, when applying the upwardly directed force; In a similar fashion, the blower 24 may be disposed on the housing with a downward motion, as represented by an arrow 42, into the second state wherein the latch 28 secures the blower 24 to the housing 22.

It will be recognized from the foregoing discussion of the vacuum cleaner 20 that the user may detach the blower 24 from the housing 22 with a simple upward motion without the necessity of actuating the latches 28 directly as is typically the case with conventional vacuum cleaners. Similarly, the blower 24 may be secured to the housing 22 with a simple downward motion without the necessity of actuating the latches 28 directly. This latter condition enhances not only the ease of operation of the vacuum cleaner 20, but it also enhances the safety of the vacuum cleaner 20 because the user is no longer required to remember to actuate the latch 28 to secure the blower 24 to the housing 22 to prevent accidental separation which may cause injury to the user and damage to the blower 24.

The vacuum cleaner 20 is now discussed in greater detail, beginning with the 22 and the blower 24 shown in FIGS. 1–4.

The housing 22 illustrated includes a generally cylindrical tank 44 having a side wall 46 and a bottom wall 48. The side wall 46 and the bottom wall 48 form a closed end 50, thereby enclosing an interior space 52 of the tank 44. An upper rim 54 of the side wall 46 defines an open end 56 opposite the closed end 50.

Disposed in the side wall 46 is a nozzle 58, to which may be attached to all manner of vacuum cleaner implements as will be readably recognized. Also provided in the side wall 46 is a drain opening (not shown), which is closed by a plug 60. The drain opening is provided in the tank 44 to permit the exhaust of fluid from the tank 44 when a vacuum cleaner 20 is used in its so-called "wet vac" mode. Also attached to the side wall 46 are handles 62 are spaced about the circumference of the side wall 46 so that the tank 44 may be tipped to remove the contents thereof.

The tank 44 is mounted on wheels 64. The wheels 64 are particularly useful when the tank 44 becomes filled either with liquid or dry material, which can make the vacuum cleaner 20 quite heavy and difficult to move or lift.

The housing 22 also includes a lid assembly 65. The lid assembly 65 includes a lid 66 that is disposed over the open end 56 of the tank 44 and latches 68 that secure the lid 66 to the tank 44.

The lid 66 is preferably a two-piece assembly consisting of a base 70 and a cover 72 which fit together in a nested relationship, i.e. an edge 74 of the base 70 receives a rim 76 of the cover 72 in a sealing relationship along at least part of an interface 78 between the base 70 and the cover 72. Moreover, the base 0 has an annular, cup-shaped channel 80 that extends about the periphery of the base 70 and cooperates with the rim 54 of the side wall 46 to form an air-tight seal. The base 70 is held against the rim 54 of the side wall 46 through the action of the latches 68 as mentioned previously.

While a tank-type housing has been illustrated, the vacuum cleaner 20 is not so limited, and may be of various configurations.

As noted above, the vacuum cleaner 20 also includes the detachable blower 24. The blower 24 includes a housing 82 with a central hub section 84 from which depends the handle 34, a nozzle 86 and a protrusion 88.

As shown in FIG. 4, the protrusion 88 is received through an opening 90 defined by a wall 92 of the cover 72 and into a depression 94 of the ba se 70. Surfaces 96, 98 of the annular wall 92 and the protrusion 88 preferably cooperate to guide the blower 24 in the directions of motion represented by the arrows 40, 42. Moreover, with the blower 24 in the second, combined state, the surfaces 96, 98 resist the blower 24 from being separated from the housing 22 when a force acts on the blower 24 at an angle to the directions of motion represented by the arrows 40, 42. Such a force may be generated by grasping the handle 34 at a single point rather than at positions 36, 38 in FIG. 1, or by gravity with the blower 24 and lid assembly 65 disposed at an angle to the horizontal, for example, when the blower 24 and lid assembly 65 are removed from the tank 44.

Figure 9:
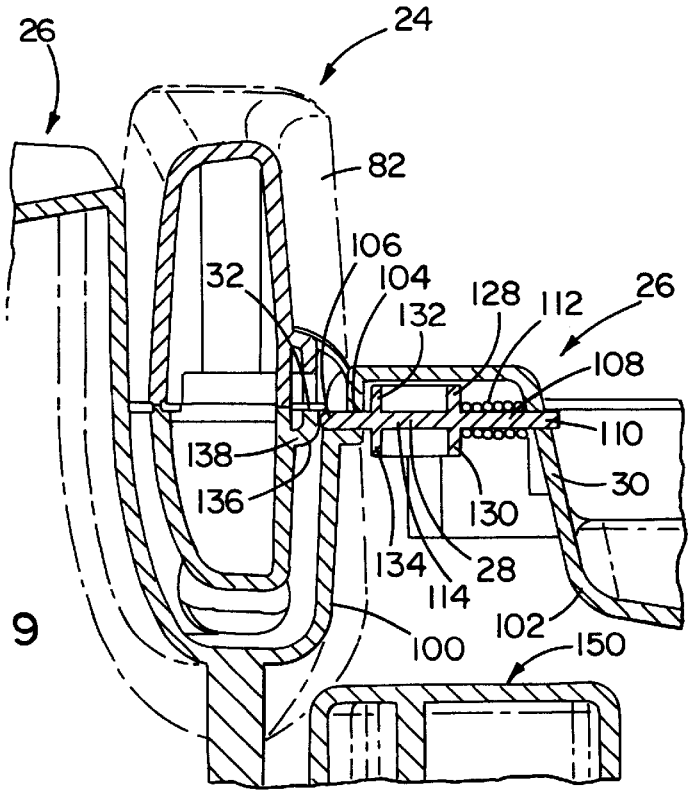
FIG. 9 is a further enlarged, partial cross-sectional view of the vacuum. cleaner with the blower in the intermediate position showing the cooperation of the blower and the latch.
Figure 8:
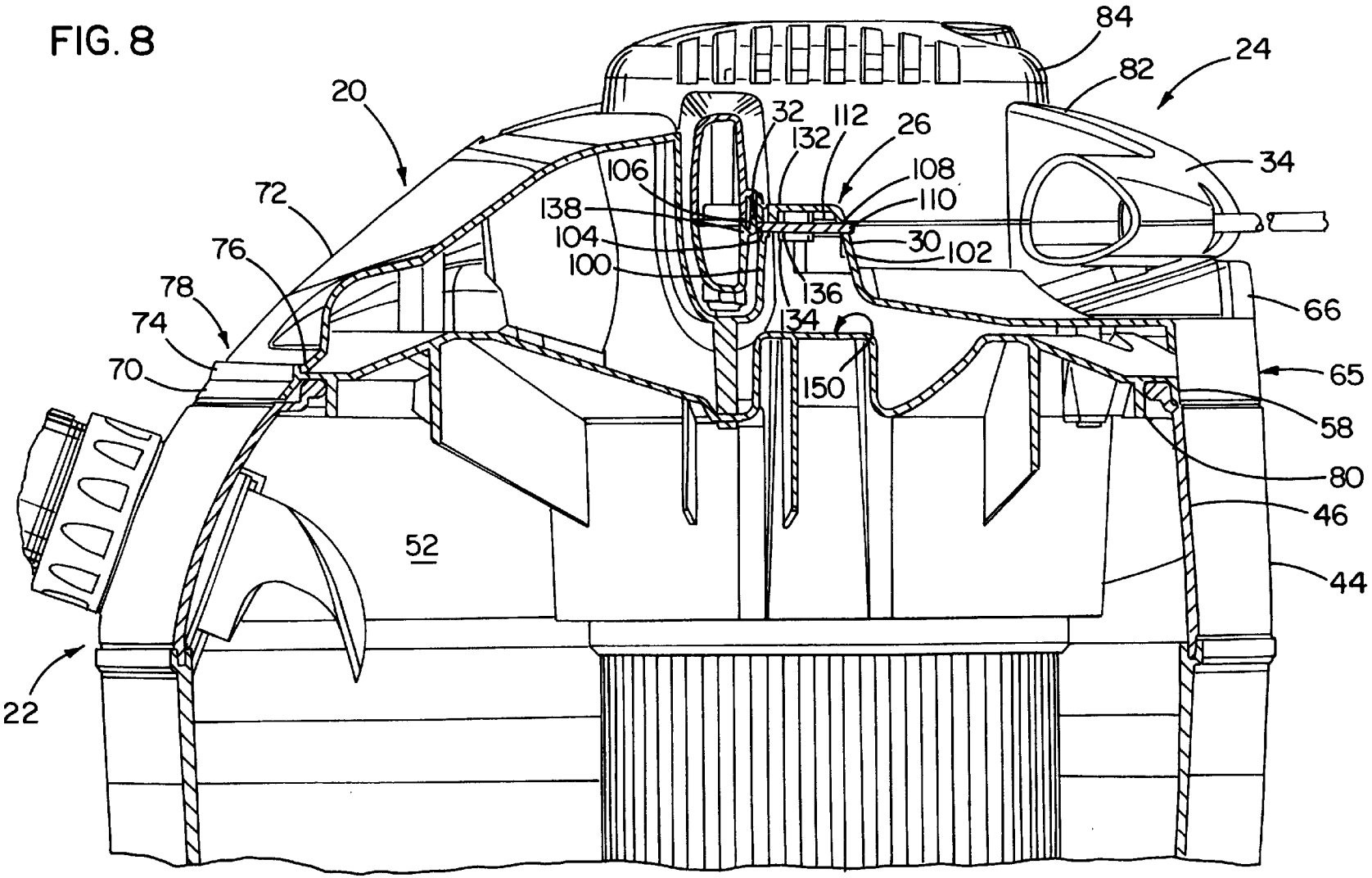
FIG. 8 is an enlarged, partial cross-sectional view of the vacuum cleaner taken about line 5—5 in FIG. 2 with the blower in an intermediate position between those shown in FIGS. 5 and 6.
Figure 14:
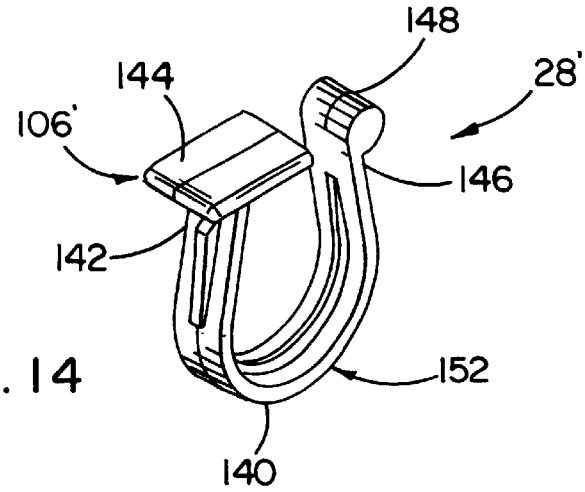
FIG. 14 is an isometric view of another embodiment of a latch.
Figure 15:
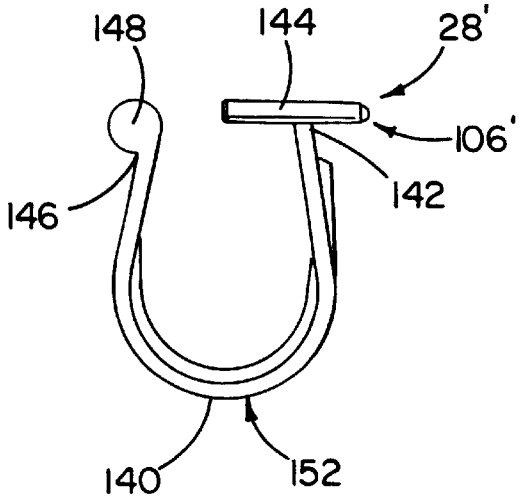
FIG. 15 is a side view of the latch of FIG. 14.
Figure 16:
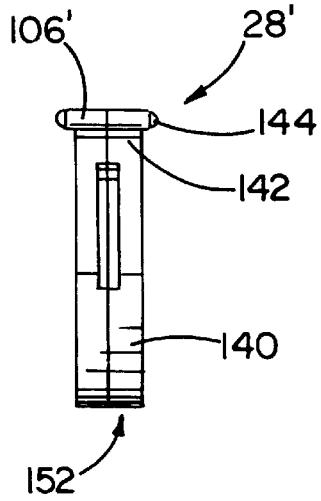
FIG. 16 is a frontal view of the latch of FIG. 14.
Figure 17:
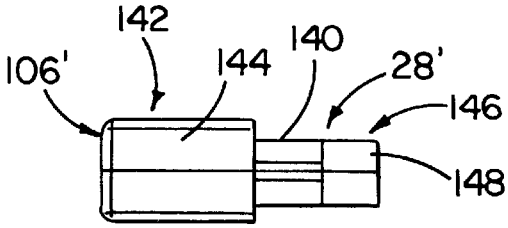
FIG. 17 is a plan view of the latch of FIG. 14.

The vacuum cleaner 20 also includes the latch assemblies 26, which are now discussed in greater detail with reference to FIGS. 5, 6, and 8, and in particular FIGS. 7 and 9.

The latch housings 30 are generally rectangularly-shaped, box-like structures that include a first, front wall 100 and a second, rear wall 102. The front wall 100 has an opening 104 to accept a forward edge 106 of the latch 28. Similarly, the rear wall 102 has an opening 108 to accept a rearward extension 110 of the latch 28. With the forward edge 106 received within the opening 104 of the front wall 100 and the rearward extension 110 received in the opening 108 of the rear wall 102, the latch 28 is constrained to move in a linear fashion between the first and second states mentioned previously.

The latch assemblies 26 also each include a spring 112 disposed between the latch 28 and the rear wall 102 of the latch housing 30. In particular, with reference to Figs, 10–13, the latch 28 includes a plate 114 with rearwardly extending legs 116, 118. The legs 116, 118 and the rearward extension 110 cooperate to define a pair of bights 120, 122 which are bounded by surfaces 124, 126. The rearward extension 110 is disposed through the coils of the spring 112, the end of which is received in the bights 120, 122 and abuts against surfaces 124, 126. The end of the spring 112 further cooperates with a post 127 to secure the spring 112 to the latch 28 to form an integral assembly.

The latch 28 further includes two oppositely depending rectangularly-shaped guide walls 128, 130. The walls 128, 130 have shoulders 132, 134. The shoulders 132, 134 abut with the front wall 100 of the latch housing 30 to prevent further motion of the latch 28 in that direction.

The operation of the latch 28 may now be discussed with reference to FIGS. 5–9.

As shown in FIG. 5, the blower 24 is detached from the housing 22. As the blower 24 is moved from this state into the state in FIG. 6 wherein the blower 24 is disposed on the housing 22, a surface 136 of a wall 138 of the housing 82 of the detachable blower 24 abuts the forward edge 106 of the latch 28 and applies a force opposite the biasing force of the spring 112. The force applied to the latch 28 through the cooperation of the surface 136 of the housing 82 and the forward edge 106 of the latch 28 causes the latch 28 to move from the state shown in FIG. 5 to that shown in FIG. 8, and in greater detail in FIG. 9. As the blower 24 moves further in the direction of the arrow 42, the surface 136 of the wall 138 moves past the forward edge 106 of the latch 28, the latch 28 returns to the position in FIG. 5. In this position, the forward edge 106 of the latch 28 cooperates with the latching surface 32 (also defined by the wall 138 of the housing 82) to secure the blower 24 to the housing 22. To remove the blower 24, the steps are reversed.

Thus, the blower 24 may be disposed on the lid assembly 65 and secured through the action of the latches 28 with a simple downward motion. Moreover, through a simple upward force applied to the blower 24, the blower 24 may be detached from the lid assembly 65. As stated above, this reduction in effort required to detach and secure the blower 24 to the housing 22, and in particular the lid assembly 65, is a significant improvement over conventional latching systems, and improves safety as well in that the user is not required to actively engage the latching system to secure the blower 24 to the housing 22.

An alternative version of the latch 28' is shown in FIGS. 14–17. Similar parts are numbered similarly, with the addition of a prime to distinguish this version from that shown in FIGS. 1–13, and more particularly in FIGS. 10–13.

The latch 28' includes a U-shaped frame 140. The frame 140 is secured at a first end 142 to a plate 144 and terminates at a second end 146 in a cylindrical knob 148. The plate 144 has a forward edge 106' which is disposed through the opening 104 of the front wall 100 of the latch housing 30 with the latch 28' disposed in the latch housing 30. The knob 148 cooperates with the rear wall 102 of the latch housing 30. A surface 150 of the base 70 of the lid 66 abuts the bight 152 of the U-shaped frame 140 to maintain the latch 28 in the latch housing 30. It is thus not necessary to provide the opening 108 in the rear wall 102 when using this version of latch.

Preferably, the U-shaped frame 140 operates similar to the spring 112 described with reference to the latch 28 described above. That is, the U-shaped frame 140 biases the forward edge 106' of the plate 144 into a first, extended position and resists the movement of the plate into a second, retracted state. Alternatively, additional springs may be secured, for example, between the first and second ends 142, 146 of the frame 140 to affect the spring force provided.

While two embodiments of latch have been illustrated in FIGS. 10–17, still other latch designs are possible, as will be recognized. As just one example, the guide walls 128, 130 may depend at 90 degrees from the orientation shown such that they would lie in the plane of the plate 114. Other aspects, objects, and advantages of the present invention will be obtained from the study of the specification, drawings and appending claims.

We claim:

1. A vacuum cleaner comprising:

a housing;

a latch assembly disposed on the housing, the latch assembly comprising a latch moveable relative to the housing between a first state and a second state; and a blower disposable on the housing and having a first state wherein the blower is detached from the housing and a second state wherein the blower is disposed on the housing, the blower comprising a latching surface disposed adjacent the latch with the blower in the second state, the blower moving the latch between the first state and the second state as the blower is moved between the first state and the second state and the latch engaging the latching surface with the blower in the second state and the latch in the first state to secure the blower to the housing.

2. The vacuum cleaner according to claim 1, wherein the latch assembly further comprises a spring attached to the latch to bias the latch into the first state.

3. The vacuum cleaner according to claim 1, wherein the blower further comprises a blower housing comprising a wall having an outer surface, the outer surface abutting the latch to move the latch between the first and second states as the blower is moved between the first and second states.

4. The vacuum cleaner according to claim 3, wherein the latch comprises a forward edge which abuts the outer surface of the blower housing and a rearward extension which cooperates with the housing to constrain the latch to move in a linear fashion.

5. The vacuum cleaner according to claim 4, wherein the latch is disposed in a latch housing having a first wall with an opening therethrough through which the forward edge of the latch is disposed and a second wall with an opening therethrough through which the rearward extension is disposed.

6. The vacuum cleaner according to claim 5, wherein the latch comprises a plate.

7. The vacuum cleaner according to claim 5, wherein the latch comprises a guide wall with a shoulder that abuts the first wall with the latch in the first state.

8. The vacuum cleaner according to claim 5, wherein the latch assembly further comprises a spring to bias the latch into the first state and the latch further comprises a guide wall with a shoulder, the spring disposed between the second wall and the shoulder of the guide wall.

9. The vacuum cleaner according to claim 8, wherein the spring is a coil spring and is disposed about the rearward extension of the latch.

10. The vacuum cleaner according to claim 1, wherein the latch comprises a U-shaped frame which cooperates with the vacuum cleaner housing to bias the latch into the first state.

11. The vacuum cleaner according to claim 10, wherein the U-shaped frame has first and second ends, the latch further comprises a planar section secured to the first end of the U-shaped frame, and the planar section defines a forward edge which cooperates with the latching surface to secure the blower to the housing.

12. The vacuum cleaner according to claim 10, wherein the latch is disposed in a latch housing having a first wall with an opening therethrough through which the forward edge of the latch is disposed, a second wall against which the rearward extension is disposed, and a third wall on which the U-shaped frame is disposed.

13. A vacuum cleaner comprising:

a housing;

a latch assembly disposed on the housing, the latch assembly comprising a latch linearly moveable relative to the housing between an extended state and a retracted state and having a forward edge; and a blower disposable on the housing and having a first, detached state wherein the blower is detached from the housing and a second, combined state wherein the blower is disposed on the housing, the blower comprising a wall having a first, outer surface which abuts the forward edge with the blower in a third state intermediate between the detached and combined states and a second, latching surface disposed adjacent the latch with the blower in the second state, the outer surface of the blower abutting the forward edge of the latch to move the latch between the extended and retracted states as the blower is moved between the detached and combined states and the forward edge of the latch engaging the latching surface with the blower in the combined state and the latch in the extended state to secure the blower to the housing.

14. The vacuum cleaner according to claim 13, wherein the latch further comprises a rearward extension which cooperates with the housing to constrain the latch to move in a linear fashion.

15. The vacuum cleaner according to claim 14, wherein the latch is disposed in a latch housing having a first wall with an opening therethrough through which the forward edge of the latch is disposed and a second wall with an opening therethrough through which the rearward extension is disposed.

16. The vacuum cleaner according to claim 15, wherein the latch comprises a plate.

17. The vacuum cleaner according to claim 15, wherein the latch comprises a wall with a forwardly-facing surface that abuts the first wall of the latch housing with the latch in the first state.

18. The vacuum cleaner according to claim 15, wherein the latch assembly further comprises a spring to bias the latch into the first state and the latch further comprises a wall with a rearwardly-facing surface, the spring disposed between the second wall and the rearwardly-facing surface of the wall.

19. The vacuum cleaner according to claim 18, wherein the spring is a coil spring and is disposed about the rearward extension of the latch.

20. The vacuum cleaner according to claim 19, wherein the latch further comprises first and second legs which depend rearwardly and are disposed on either side of the rearward extension so as to define first and second bights, the first bight between the first leg and the rearward extension and the second bight between the second leg and the rearward extension, an. end of the spring being received in the first and second bights with the spring disposed about the rearward extension of the latch.

21. A vacuum cleaner comprising:

a housing;

a detachable blower comprising a handle; and a latching assembly comprising a latch which engages the blower with the blower disposed on the housing to secure the blower to the housing, the handle of the blower being graspable with both hands to apply an upward force to the blower to disengage the latch from the blower and thereby detach the blower from the housing.

22. The vacuum cleaner according to claim 21, wherein the housing includes a surface on which the thumbs of both hands are disposed as the upward force is applied to the blower to disengage the latch from the blower.

* * * * *

UNITED STATES PATENT AND TRADEMARK OFFICE

CERTIFICATE OF CORRECTION

PATENT NO. : 6,484,351 B2 
DATED : November 26, 2002
INVENTOR(S) : Ronald Griffin and Craig Seasholtz It is certified that error appears in the above-identified patent and that said Letters Patent is hereby corrected as shown below:

Column 3,
Line 52, cancel "secondstates" and insert -- second states --.

Column 4,
Line 29, cancel "handles 62 are spaced" and insert -- handles 62. The handles 62 are spaced --;
Line 46, cancel "the base 0" and insert -- the base 70 --;
Line 61, cancel "the ba se 70" and insert -- the base 70 --.

Column 8,
Line 32, cancel "an. end" and insert -- an end --.

Signed and Sealed this

Eleventh Day of March, 2003

JAMES E. ROGAN
*Director of the United States Patent and Trademark Office*